US006288339B1

(12) United States Patent
Efraimsson et al.

(10) Patent No.: US 6,288,339 B1
(45) Date of Patent: Sep. 11, 2001

(54) SELF-SUPPORTING CABLE

(75) Inventors: Lars-Olof Efraimsson; Ulf Johnsen, both of Falun (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/171,661

(22) PCT Filed: Apr. 18, 1997

(86) PCT No.: PCT/SE97/00666

§ 371 Date: Jun. 21, 1999

§ 102(e) Date: Jun. 21, 1999

(87) PCT Pub. No.: WO97/40504

PCT Pub. Date: Oct. 30, 1997

(30) Foreign Application Priority Data

Apr. 23, 1996 (SE) ..... 9601538

(51) Int. Cl.[7] ..... H01B 7/18

(52) U.S. Cl. ..... 174/102 R; 174/105 R; 174/105 SC

(58) Field of Search ..... 174/102 R, 105 SC, 174/102 SC, 102 SP, 102 D, 103, 105 R, 106 D, 107, 109

(56) References Cited

U.S. PATENT DOCUMENTS 4,256,921 * 3/1981 Bahder ..... 174/107
4,378,462 * 3/1983 Arnold et al. ..... 174/70 R
4,749,823 * 6/1988 Ziemek et al. ..... 174/103
4,780,574 * 10/1988 Neuroth ..... 174/102 D
4,956,523 9/1990 Pawluk ..... 174/107
5,191,173 * 3/1993 Sizer et al. ..... 174/105 R
5,527,995 * 6/1996 Lasky ..... 174/102 SC

FOREIGN PATENT DOCUMENTS 1 790 251 1/1972 (DE) .
0 268 286 11/1987 (EP) .
0 461 794 12/1991 (EP) .
33 129 10/1963 (FI) .

* cited by examiner

*Primary Examiner*—Dean A. Reichard
*Assistant Examiner*—William H. Mayo, III
(74) *Attorney, Agent, or Firm*—Burns, Doane, Swecker & Mathis, L.L.P.

(57) ABSTRACT

Self-supporting cables include at least one insulated conductor that includes a conductor having at least one wire and an insulation around the cable conductor. The cable further includes at least one longitudinally extending shield band and a jacket. The shield band is rigid in a radial direction and includes undulations that extend mainly in a tangential direction. The shield band includes undulations which correspond to the jacket undulations. A weak radially acting compressive force causes the jacket undulations and the shield band undulations to cam into each other, such that the force of gravity acting on the cable between the cable fixing points is transmitted into the conductors, and an axially acting force in the absence of slippage between the different cable layers. The cable becomes self-supporting by virtue of the mechanical strength of the conductors.

12 Claims, 2 Drawing Sheets

SELF-SUPPORTING CABLE

FIELD OF INVENTION

The present invention relates to self-supporting cables.

BACKGROUND OF THE INVENTION

As will be evident from FI 33129 and EP 0 461 794, for instance, it is known to make aerial cables self-supporting by integrating a support line in the cable. It is also known to provide cables of improved tensile strength by embedding tension force relieving members in the cable insulation, c.f. U.S. Pat. No. 4,956,523. It is also known to provide a cable of high tensile strength, by placing a reinforcement comprising, e.g., glass fibre wires immediately inwards of the outer jacket; c.f. DE 17 90 251 or EP 0 268 286.

SE 8105835-6 teaches a cable that includes a shield band about each insulated conductor of the cable. The cable is not self-supporting, however.

SUMMARY OF THE INVENTION

One problem with known self-supporting cables is that they consist of many different insulated conductors or many different layers. This makes the cable expensive and complicated to manufacture, and in some cases difficult to install.

One object of the present invention is to provide a self-supporting cable that can withstand the strain caused by a falling tree, for instance.

Another object of the present invention is to provide a self-supporting cable of simple and inexpensive manufacture and which can be easily installed.

These objects are achieved in accordance with the invention with a cable that comprises at least one insulated conductor where each insulated conductor includes a conductor that has a conductor insulation. A longitudinally extending shield band provided with grooves or corresponding undulations is applied around each insulated conductor, either completely or partially. The cable includes an outer extruded jacket. As the jacket is extruded, corresponding undulations are also formed in the jacket and in the conductor insulation. The undulations on the various cable conductors grip into one another when the cable is subjected to mechanical load, so as to prevent sliding or slippage between the various conductors. This enables the load generated by the weight of the cable to be transferred inwardly to the cable conductors as an axially directed force that the conductors carry by virtue of its inherent mechanical strength among other things.

The inventive self-supporting cable has the advantages of being simple and inexpensive in manufacture and of being easily installed. Other advantages are that the cable need not be made round and that the shield bands form a mechanical protection that is particularly effective against punctiform pressures.

The invention will now be described in more detail with reference to preferred exemplifying embodiments thereof and a also with reference to the accompanying drawings.

DETAILED DESCRIPTION OF PREFERRED EMBODIMENTS

Cable

Figure 1:
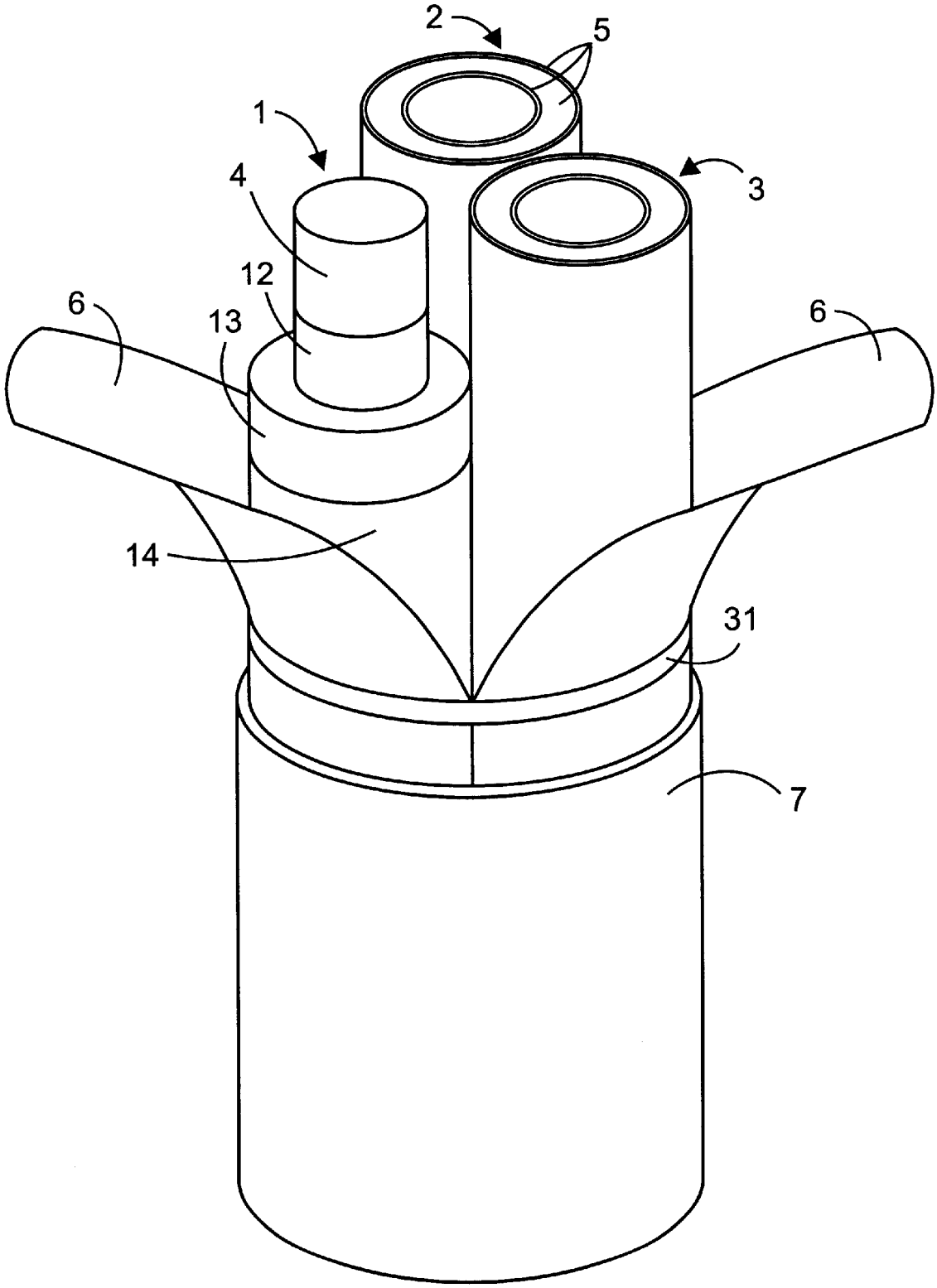
FIG. 1 is a perspective view of one cable embodiment.
Figure 2:
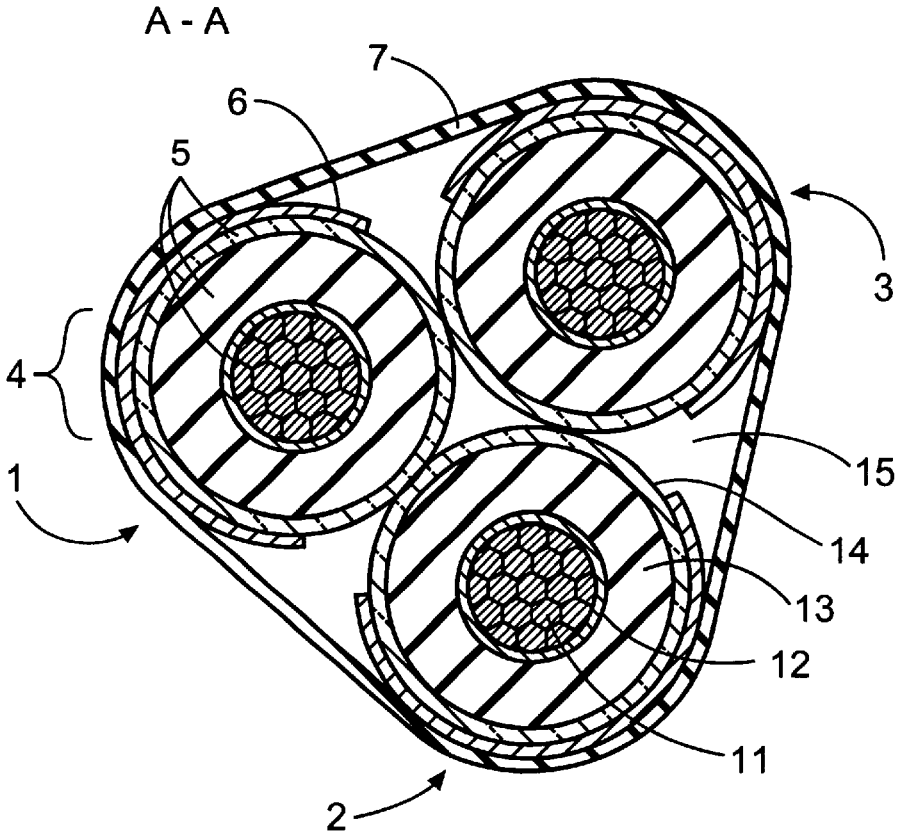
FIG. 2 is a cross-sectional view of one cable embodiment, taken on the lines A—A in FIG. 3.

FIG. 1 is a perspective view of a cable, while FIG. 2 is a cross-sectional view of the same cable, from which it will be seen that the cable includes three insulated conductors 1, 2, 3. The number of conductors may be more or fewer than three. Each conductor 1, 2, 3 includes a conductor 4 and a conductor insulation 5.

The conductor 4 is comprised of a plurality of drawn, combined and twisted wires 11, comprised of aluminium or copper, for instance. The illustrated embodiment includes nineteen wires. Although it is possible to use only one wire 11, mechanical strength will be enhanced by using a plurality of wires. Swell yarn or swell powder may be incorporated in conjunction with combining the wires, as protection against the ingress of water. An innermost semi-conductor layer 12 is extruded around a conductor 4. An insulating layer 13 is extruded around the innermost semiconductor layer 12, and an outer semiconductor layer 14 is extruded around said insulating layer 13. The two semiconductor layers 12, 14 may be comprised of an electrically conductive plastic and the insulating layer 13 may be comprised of cross-linked polyethene (PEX). The three layers 12, 13, 14 make up the conductor insulation 5.

The cable conductors 1, 2, 3 are twisted, or twined, so as to enhance their mechanical strength. Each insulated conductor 1, 2, 3 is partially embraced by a shield band 6. Poorer mechanical strength can be expected when only one insulated conductor 1 is used and the shield band 6 should, in this case, fully embrace the conductor 1.

Although there will preferably be used one shield band 6 with each conductor 1, it is conceivable to use more or fewer shield bands 6 than the number of conductors 1 present.

The shield band 6 includes undulations 22, 23 such as grooves or the like that extend essentially tangentially and that are comprised, for instance, of a fabric of tin-plated copper wires. Alternatively, grooved metal foil or undulating copper wires between plastic foils may be used.

A jacket 7 is extruded around all conductors 1, 2, 3. The jacket 7 may conveniently be comprised of a strong polyethene or some other material with low cold-flow, so as to avoid deformation of the jacket in the passage of time. The material will also preferably have a certain degree of elasticity that will provide flexibility, see below.

Figure 3:
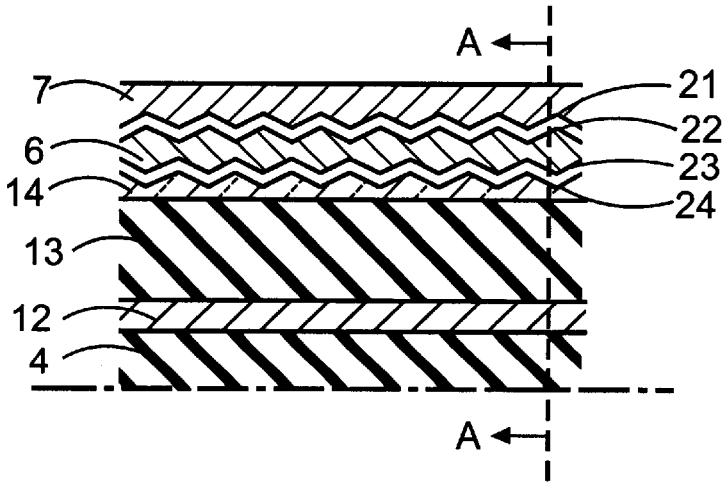
FIG. 3 is a longitudinal sectional view of one cable embodiment.

The shield band 6 is sufficiently rigid in its radial direction to enable the undulations 22 thereon to be reproduced on the inner surface of the jacket 7, these undulations being referenced 21; see FIG. 3. Grooves 24 are also preferably formed on the outer semiconductor layer 14, and hence this layer must be relatively soft. The outer semiconductor layer 14, however, must be sufficiently strong to be prevent it from being easily broken, and it may also be strippable. These criteria are satisfied when the outer semiconductor layer 14 includes an inner relatively hard layer and an outer softer layer.

The shield bands 6 will also preferably be soft in an axial direction, so as to result in a flexible cable and so that the outermost semiconductor layers 14 will not be crushed when the cable bends or is subjected to load.

On the one hand the undulations 21 on the jacket 7 and the undulations 22 and on the other hand the undulations 23 on the shield bands and the undulations 24 on the outer semiconductor layers firmly grip in one another when the cable is subjected to load. This prevents undesired slippage or creepage between the different cable conductors, therewith enabling the jacket 7 to be extruded around the conductors more loosely than would otherwise have been necessary. The resultant cable is thus more flexible than it would have been in the absence of said undulations. This is because the jacket 7 is able to slide against the shield bands 6 to some extent, in the absence of load on the cable. This sliding of the jacket 7 is made possible because the undulations 21 on the jacket 7, which is slightly elastic, "jump" in the undulations 22 on the shield bands 6. Corresponding "jumps" can also occur between the shield band undulations 23 and the undulations 24 on the outer semiconductor layers. This is desirable, because undesirable tension and compression forces would otherwise occur as the cable is bent. Because the undulations 21, 22, 23, 24 are in mutual engagement after the cable has been bent, the extent to which the cable "springs back" when the bending force is relieved will be reduced.

The self-supporting capacity of the cable is achieved by virtue of the mutual engagement of on the one hand the jacket undulations 21 and the shield band undulations 22, and on the other hand the shield band undulations 23 and the undulations 24 on the outer semiconductor layers, when a weak radially acting compressive force is applied on cable fixing or installation points. This enables the gravitational force acting on the cable between the cable fixing or installation points as an axially acting force to be transmitted into the conductors 4 in the absence of sliding or slippage between the different cable layers, wherewith the cable becomes self-supporting by virtue of the inherent mechanical strength of the conductors 4.

The aforedescribed use of shield bands 6 obviates the need for filling in order to maintain the integrity of the shield construction. The aforedescribed use of shield bands 6 also enables the cable to be given for example a triangular cross-sectional shape, as shown in FIG. 1, instead of needing to be round. When desiring a more watertight cable, the empty spaces 15 may be filled with swell yarn or swell powder.

Cable Manufacture

In one method of manufacture, an electro-refined aluminium rod is first drawn to a wire of suitable diameter or thickness, preferably 2–3 mm. A plurality of wires 11, preferably 19 in number, are then brought together and twisted or twined to form a conductor 4, optionally with the inclusion of swell yarn 16 or swell powder.

The conductor 4 is then fed into an extruder in which three insulation layers 12, 13, 14 are extruded simultaneously on the conductor 4. The thus produced cable conductor 1 is then cooled with water and thereafter wound onto a drum.

Three cable conductors 1, 2, 3 are then delivered to a cabling machine in which each of said conductors is provided with a respective shield band 6, whereafter the cable assembly is twisted about its longitudinal axis. The shield bands 6 are held in position by locking said bands securely at regular intervals with the aid of a thread or wire 31, preferably a non-spun thread, or a strip 31 of some suitable material. The strip 31 will preferably be made of a material similar to the jacket material, so that the strip is able to fuse into the jacket as the jacket is extruded thereon. Alternatively, metal strips or the like may be used.

The twisted or twined cable conductors 1, 2, 3 are then fed to another extruder, in which a jacket 7 is extruded at a pressure with which the shield band undulations 22 will be reproduced on the inner side of the jacket 7 in the form of undulations 21. It is also preferred to form undulations 24 on the outer semiconductor layer 14 at this stage of manufacture. The tightness with which the jacket is extruded on the cable conductors is a question of balance. If the jacket is extruded too tightly, the cable will become very rigid and "jumping" of the undulations 21, 22 over one another becomes difficult, as will be evident from the aforegoing.

The manufactured cable is then cooled and wound onto a drum.

What is claimed is:

1. A self-supporting cable comprising at least one insulated conductor that includes a conductor having at least one wire and a conductor-insulation, at least one longitudinally extending shield band, and a jacket surrounding the at least one insulated conductor wherein each shield band is provided with undulations that extend generally tangentially, and is radially rigid; and the jacket has undulations that correspond to the shield band undulations, the jacket being slidable relative to the shield band, wherein said jacket undulations and said shield band undulations grip into one another in response to relatively low radially acting pressure forces on cable fixing points thereby preventing the relative sliding between the jacket and shield band, such that tension forces and gravitational forces acting on the cable between said fixing points can be transmitted into the conductor as an axially extending force in the absence of slippage, such that the cable becomes self-supporting by virtue of intrinsic mechanical strength possessed by the conductor.

2. A self-supporting cable according to claim 1, wherein the insulation on said at least one conductor comprises an inner semiconductor layer, an insulating layer, and an outer semiconductor layer, wherein the inner and outer semiconductor layers are formed of an electrically conductive plastic; and the outer semiconductor layer includes undulations, the undulations on the outer semiconductor layer grip with the shield band undulations in response to pressure that acts radially on the cable.

3. A self-supporting cable according to claim 2, wherein the outer semiconductor layer includes an inner relatively hard layer and an outer layer that is softer than said inner layer.

4. A self-supporting cable according to claim 2, wherein the shield band has low rigidity in its axial direction, such as to provide a flexible cable.

5. A self-supporting cable according to claim 1, wherein the at least one shield band is comprised of a woven metal wire fabric of tin-plated copper wires.

6. A self-supporting cable according to claim 1, wherein said at least one shield band includes undulating metal wires disposed between plastic foils.

7. A self-supporting cable according to claim 1, wherein said at least one shield band includes undulating metal foil.

8. A self-supporting cable according to claim 1, wherein the jacket undulations grip in shield band undulations; and the elasticity of the jacket is such as to enable the jacket undulations to jump within the shield band undulations as the cable bends.

9. The self-supporting cable of claim 1, wherein the jacket undulations are on an inner surface of the jacket.

10. A cable comprising:

a conductor;

a conductor-insulation;

a longitudinally extending shield band, the shield band comprises undulations on both an inner surface and an outer surface of the shield band;

a semiconductor layer between the shield band and the conductor-insulation, the semiconductor layer comprises undulations which grip into the undulations on the inner surface of the shield band; and a jacket, the jacket comprises undulations which are normally spaced from the shield band undulations but which grip into the undulations on the outer surface of the shield band upon application of radially acting pressure forces to the cable.

11. The cable of claim 10, wherein the jacket undulations are slightly elastic and can jump in the undulations on the outer surface of the shield band.

12. The cable of claim 11, wherein the semiconductor layer undulations can jump in the undulations on the inner surface of the shield band.

* * * * *